United States Patent [19]

Thompson

[11] 4,086,941

[45] May 2, 1978

[54] BIPLANAR PAPERMAKER'S BELT

[75] Inventor: Charles E. Thompson, Albany, N.Y.

[73] Assignee: Huyck Corporation, Wake Forest, N.C.

[21] Appl. No.: 735,263

[22] Filed: Oct. 26, 1976

[51] Int. Cl.[2] ..... D03D 3/04

[52] U.S. Cl. ..... 139/387 R; 139/383 B; 139/408

[58] Field of Search ..... 139/383 A, 408, 409, 139/410, 411, 412, 413, 414, 415, 387 R; 162/358

[56] References Cited

U.S. PATENT DOCUMENTS

| | | | |
|---|---|---|---|
| 1,050,406 | 1/1913 | Veit | 139/383 A |
| 1,812,148 | 6/1931 | Hindle | 139/408 |
| 1,879,243 | 9/1932 | Hoffacker | 139/383 A |
| 2,047,542 | 7/1936 | Barrell | 139/383 A |
| 2,180,054 | 11/1939 | Hindle et al. | 139/408 |
| 2,854,032 | 9/1958 | Santos | 139/383 A |
| 2,857,654 | 10/1958 | Sexton | 139/413 |

*Primary Examiner*—Henry S. Jaudon
*Attorney, Agent, or Firm*—Sanford S. Waddler

[57] ABSTRACT

A papermaker's belt particularly suited for use as a forming fabric, the fabric being of biplanar construction with sets of upper and lower filling yarns interconnected by warp yarns extending between the upper and lower surfaces of the fabric, the fabric being characterized by diagonally disposed sets of upper and lower filling yarns with the warp yarns extending diagonally between adjacent sets of the filling yarns in one direction and diagonally between the upper and lower yarns of another set of filling yarns in the opposite direction.

9 Claims, 4 Drawing Figures

BIPLANAR PAPERMAKER'S BELT

This invention relates to papermaker's belts and has to do with a biplanar fabric for clothing the forming area of the papermaking machine, although fabrics in accordance with the invention also may be used for other paper machine applications.

BACKGROUND OF THE INVENTION

Fundamentally, the forming area of the papermaking machine has been clothed by fabrics woven from synthetic materials, i.e., man-made fibers. The general structure of these fabrics has taken two basic forms — the first comprising a monoplane fabric and the second a double layer or duplex fabric. In a monoplane fabric the woven members travel through the fabric passing from one surface to the other surface in each repeat of the pattern across the width and length of the fabric. The successive warp or filling members will lie side-by-side as near to the center plane of the fabric as the balance in the weave pattern will permit, with the warp and filling yarns interlaced. Thus, the weave pattern, float length and stiffness/diameter of the yarn are the controlling factors which establish the parameters of the fabrics which can be formed. In order to achieve greater strength, stiffness and service life, a double layer or duplex fabric has been used.

A duplex fabric is one in which greater stiffness and strength is obtained by using stacked filling yarns, i.e., sets of filling yarns which are stacked one above the other in two planes. In a duplex fabric, the filling yarns do not interlace from surface to surface; rather, the warp yarns form a double house for the filling yarns in such a way that the sets of filling yarns remain directly over and under each other, the warp yarns crisscrossing between the filling yarns on each side of the fabric, the warp yarns thereby locking the filling yarns in their over and under configuration.

A typical duplex fabric, identified as "prior art", is illustrated in FIG. 1. As seen therein, warp yarns 1, 2, 3 and 4 (which in use lie in the cross-machine direction when the fabric is endless and in the machine direction when the fabric is woven flat) pass between the sets of filling yarns, the yarns 6 and 7 in each set being stacked one above the other in spaced apart planes. The weave illustrated produces an identical pattern on each surface of the fabric. A duplex pattern of this character has been found to have certain disadvantages, particularly when used as a forming fabric. One of the disadvantages results from the cross-machine knuckles which are formed at the points 8 where the warp yarns pass around the filling yarns 7 on the bottom surface or machine side of the fabric. These knuckles are particularly subject to wear and offer minimal protection to the load bearing machine direction yarns 7. In addition, the knuckles coincide with and accentuate the straight and rigid machine direction yarns 7 and create tracking and roll oscillation problems.

Another problem inherent in duplex weave patterns currently in use is the presence of open areas or pockets, indicated at 9 in FIG. 1, which in numerous instances create fabrics having an excessively open construction which causes dimensional instability. In addition, where such open areas exist, reactive forces are captured within the cross-machine yarns 1, 2, 3 and 4 as they cross and interlace between the sets of machine direction yarns 6 and 7. These reactive forces create rigidity relative to any two sets of machine direction pairs, and this restrictive condition in a fabric which inherently has little cross-machine stability prevents the flow and redistribution of the stress producing forces, thereby contributing to the formation of undersirable pockets, roping and wrinkles.

The present invention seeks to overcome the foregoing disadvantages by providing biplanar fabrics which close the objectionable open areas and at the same time provide greater fabric life, particularly on the machine wear surface, as well as better tracking and smoother running with less fatigue related problems.

SUMMARY OF THE INVENTION

In accordance with the invention the sets of machine direction or filling yarns, while formed in two planes, are not stacked directly over and under each other, but rather the two yarns in each set are offset laterally relative to each other so that the sets of filling yarns are diagonally disposed and lie in what may be characterized as interdigitating relation. This configuration effectively closes the open areas or pockets which are characteristic of conventional duplex fabrics.

Another feature of the invention lies in the increased exposure of the warp or cross-machine direction yarns on one side of the fabric. Increased exposure of the warp yarns on the machine side of the fabric acts to reduce wear of the machine direction filling yarns, which are the load bearing members when the fabric is in use. For example, the warp yarns may be given two and two floats on the machine surface of the fabric to provide greater fabric life as well as better tracking and smoother running. Other weave patterns also may be used, the essential consideration being the increased exposure of the cross-machine direction yarns on the machine side of the fabric.

For certain papermaking applications, the fabric can be inverted so that the paper is formed on the surface of the fabric having the greater exposure of cross-machine direction warp yarns. In this instance the surface characterics of the paper forming surface are improved and machine drag is reduced on the machine surface of the fabric.

Accordingly, a principal object of the invention is the provision of biplanar fabrics having improved machine direction strength as well as improved cross-machine stability.

Another object of the invention is the provision of fabrics having sets or pairs of filling yarns formed in biplanar relation, by which is meant that the upper and lower filling yarns do not necessarily lie in spaced apart planes as in a conventional duplex fabric, but rather the planes defined by their facing surfaces may coincide or overlap. This biplanar relationship is the result of the diagonal disposition of the sets of filling yarns relative to each other and the manner in which the warp yarns pass between them, the warp yarns in one direction passing diagonally from one surface of the fabric to the other between adjacent pairs of the laterally offset filling yarns, and diagonally between the upper and lower filling yarns in another set in the opposite direction, thereby effectively closing the open areas or pockets which are formed when the filling yarns are stacked one above the other and the warp yarns are passed diagonally between the two yarns in each vertically aligned pair.

A further object of the invention is the provision of biplanar fabrics which are particularly suited for clothing the forming area of a papermaking machine, the fabrics providing enhanced stability and longer useful life.

DESCRIPTION OF THE PREFERRED EMBODIMENTS

Figure 1:
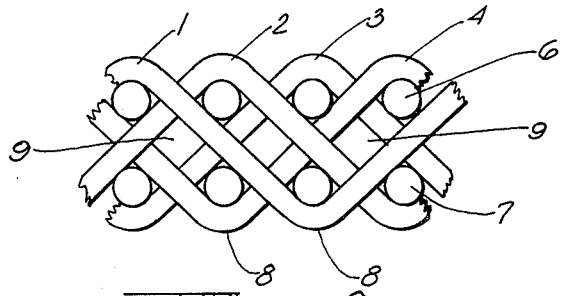
FIG. 1 PRIOR ART
FIG. 1 is a diagrammatic vertical sectional view illustrating a conventional prior art duplex fabric.
Figure 2:
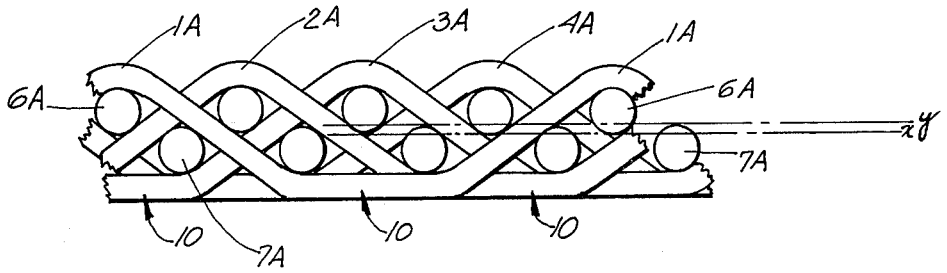
FIG. 2 is a diagrammatic vertical sectional view illustrating a fabric in accordance with the present invention.

Referring now to FIG. 2 of the drawings, the fabric illustrated comprises warp yarns 1A, 2A, 3A and 4A, together with sets of filling yarns 6A and 7A which, in accordance with the invention, are diagonally disposed relative to each other. In effect, the filling yarns 7A, which in this instance are on the machine side of the fabric, lie in interdigitating relation relative to the filling yarns 6A. The upper and lower filling yarns may lie in spaced apart planes although preferably the facing surfaces of the upper and lower filling yarns in each set will overlap, as illustrated by the planes *x* and *y* in FIG. 2. The warp yarns 1A–4A also extend diagonally between the upper and lower surfaces of the fabric. Thus, the yarn 1A passes over the yarn 6A of the first or leftmost set of filling yarns and then diagonally downwardly between the first and second sets of filling yarns, the yarn 1A then extending along the bottom surface of the fabric until it passes under the yarn 7A of the third set of filling yarns, whereupon it extends diagonally upwardly between the yarns 6A and 7A of the fourth set of filling yarns, the pattern being repeated as the yarn 1A passes over the yarn 6A of the fifth or rightmost set of filling yarns illustrated.

In like manner, the warp yarn 2A passes over the yarn 6A of the second set of filling yarns and extends diagonally downwardly between the second and third sets of filling yarns, the yarn 2A then extending along the bottom surface of the fabric until it passes under the yarn 7A of the fourth set of filling yarns, whereupon it passes diagonally upwardly between the yarns 6A and 7A of the fifth set of filling yarns so that the pattern is repeated as the warp yarn 2A passes over the filling yarn 6A in the sixth set of filling yarns (not shown). As will be evident from FIG. 2, the warp yarns 3A and 4A will successively follow a like pattern, which pattern may be characterized by the warp yarn passing over the upper filling yarn in a first diagonally disposed set of filling yarns and then diagonally downwardly between the first and a second set of diagonally disposed filling yarns and then under the lower filling yarn in the second set as well as under the lower filling yarn in the next adjacent or third set of diagonally disposed filling yarns, whereupon the warp yarn extends diagonally upwardly between the upper and lower filling yarns of a fourth set of the diagonally disposed filling yarns. Each of the warp yarns has two floats, indicated at 10, and the resultant fabric has the surface characteristics of a twill weave.

Figure 3:
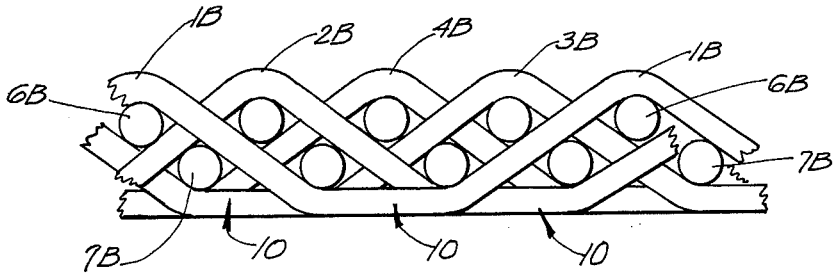
FIG. 3 is a diagrammatic vertical sectional view illustrating a modification having a different weaving pattern.

As will be readily understood by the worker in the art, the pattern lends itself to a number of variations, one of which is illustrated in FIG. 3. As seen therein, the basic pattern is the same, namely, over one upper filling yarn in a first diagonal set, diagonally downwardly between the first and second sets of filling yarns, beneath two lower filling yarns in the second and third sets, and then diagonally upwardly between the upper and lower filling yarns of the fourth set. Thus warp yarns 1B and 2B are the same as in FIG. 2, but in this instance the positions of warp yarns 3B and 4B are reversed, with warp yarn 3B passing over the upper filling yarn in the fourth set, whereas warp yarn 4B passes over the upper filling yarn in the third set. Such rearrangement results in a variation in both the top and bottom surfaces of the fabric forming a four harness satin or crow's foot pattern on the top surface.

It will be understood that additional pattern variations may be achieved by altering the sequence of the warp yarns, as for example, 1, 3, 2, 4, as will be understood by the worker in the art. In addition, the number of warp yarns may be increased to provide additional variations in either or both surfaces of the fabric being formed, the essential considerations being the diagonal disposition of the sets of filling yarns and the greater exposure of the warp yarns on one surface of the fabric.

Figure 4:
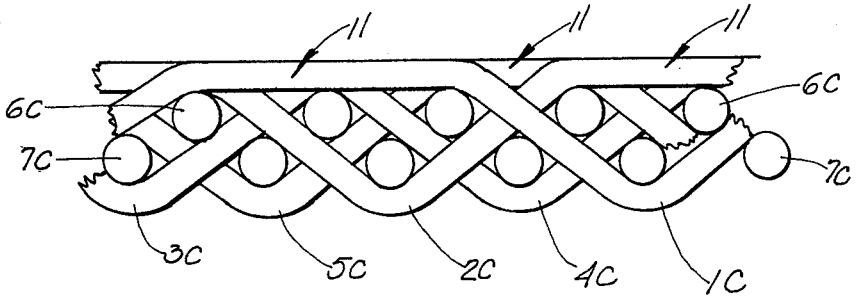
FIG. 4 is also a diagrammatic vertical sectional view illustrating another modification of the invention.

While a preference is expressed for a pattern wherein the warp yarns pass under two adjacent lower filling yarns, the number of filling yarns beneath which each warp yarn passes may be increased. For example, each of the warp yarns may pass beneath three or four, or even more, adjacent lower filling yarns before returning diagonally upwardly to the upper surface of the fabric. If the fabric is to be used in inverted condition, it will be understood that the two, three or more float configuration will be on the upper or papermaking side of the fabric. Thus, as illustrated in FIG. 4, a fabric is provided comprising warp yarns 1C, 2C, 3C, 4C and 5C, together with diagonally disposed sets of upper and lower filling yarns 6C and 7C, thereby providing an inverted fabric in which the warp yarns have a three float pattern, indicated at 11.

The nature of the materials from which both the warp and filling yarns are formed does not constitute a limitation on the invention. Normally the yarns will be synthetic and may comprise either monofilament or multifilament yarns, or combinations thereof.

It is to be understood that modifications may be made in the invention without departing from its spirit and purpose, and consequently it is not intended that the invention be limited other than in the manner set forth in the claims which follow. It is also to be understood that the terms "upper" and "lower" as they appear in the claims are used in a relative sense to set forth the relationship between the warp and filling yarns, the fabrics being reversible depending upon the characteristics desired for their respective paper and machine surfaces.

The embodiments of the invention in which an exclusive property or privilege is claimed are defined as follows:

1. An endless papermaker's fabric for use on a papermaking machine, said fabric having continuous filling yarns extending in the machine direction and warp yarns extending in the cross-machine direction to define the width of the fabric, said fabric comprising sets of spaced apart upper and lower filling yarns interconnected by warp yarns to form a biplanar fabric having an upper paper contacting surface and a lower machine contacting surface, said sets of filling yarns being diagonally disposed relative to each other with said warp yarns extending diagonally downwardly from the top to the bottom surfaces of the fabric between adjacent sets of said filling yarns, and extending diagonally upwardly from the bottom to the top surfaces of the fabric between the upper and lower filling yarns of another of said sets of diagonally disposed filling yarns, the upper and lower filling yarns being separated solely by said warp yarns, whereby the filling yarns lie in biplanar relation with respect to each other.

2. The papermaker's fabric claimed in claim 1 wherein each of said warp yarns passes over the upper filling yarn in a first of said diagonally disposed sets of upper and lower filling yarns and beneath the lower filling yarns of at least the next two adjacent sets of filling yarns.

3. The papermaker's fabric claimed in claim 2 wherein each of said warp yarns passes over a single upper filling yarn and then beneath the lower filling yarns of the next two adjacent sets of filling yarns, each warp yarn then extending diagonally upwardly between the upper and lower filling yarns of the next succeeding set of filling yarns.

4. The papermaker's fabric claimed in claim 1 wherein the upper and lower filling yarns lie in spaced apart planes.

5. The papermaker's fabric claimed in claim 1 wherein the facing surfaces at least of the upper and lower filling yarns lie in overlapping planes.

6. In an endless papermaker's belt having spaced apart sets of longitudinally extending load bearing upper and lower filling yarns interconnected by transversely extending warp yarns defining the width of the fabric, the improvement which comprises diagonally disposing said sets of upper and lower filling yarns so that they lie in interdigitating relation with respect to each other, with said warp yarns extending diagonally between adjacent sets of said filling yarns in one direction and extending diagonally between the upper and lower yarns of another set of said filling yarns being separated from each other by the diagonally extending portions of the warp yarns, whereby the filling yarns lie in biplanar relation with respect to each other.

7. The papermaker's belt claimed in claim 6 wherein each of said warp yarns passes over the upper filling yarn of a single set of said filling yarns and beneath the lower filling yarns of at least the next two adjoining sets of filling yarns.

8. The papermaker's belt claimed in claim 6 wherein the upper and lower filling yarns lie in spaced apart planes.

9. The papermaker's belt claimed in claim 6 wherein the facing surfaces of the upper and lower filling yarns overlap each other.

* * * * *

UNITED STATES PATENT OFFICE
CERTIFICATE OF CORRECTION

Patent No. 4,086,941 Dated May 2, 1978

Inventor(s) Charles E. Thompson

It is certified that error appears in the above-identified patent and that said Letters Patent are hereby corrected as shown below:

On Title and Cover Page: Change attorney's name from "Sanford S. Waddler" to "Sanford S. Wadler"

In Column 2, Line 40-41: Change "characterics" to "characteristics"

Signed and Sealed this

*Third* Day of *October 1978*

[SEAL]

*Attest:*

RUTH C. MASON
*Attesting Officer*

DONALD W. BANNER
*Commissioner of Patents and Trademarks*

UNITED STATES PATENT AND TRADEMARK OFFICE

CERTIFICATE OF CORRECTION

PATENT NO. : 4,086,941

DATED : May 2, 1978

INVENTOR(S) : Charles E. Thompson

It is certified that error appears in the above-identified patent and that said Letters Patent are hereby corrected as shown below:

In Column 6, Line 14, after "yarns" (second occurrence) insert - in the opposite direction, the upper and lower filling yarns -.

Signed and Sealed this

*Second* Day of *October 1979*

[SEAL]

*Attest:*

RUTH C. MASON
*Attesting Officer*

LUTRELLE F. PARKER
*Acting Commissioner of Patents and Trademarks*